US011261052B2

(12) United States Patent
Castañeda

(10) Patent No.: US 11,261,052 B2
(45) Date of Patent: Mar. 1, 2022

(54) AMBIDEXTURAL RETRACTING REEL AND DEVICE SECURABLE TO AN ARTICLE

(71) Applicant: WEST COAST CHAIN MFG. CO., Ontario, CA (US)

(72) Inventor: Andrew Castañeda, Anaheim, CA (US)

(73) Assignee: WEST COAST CHAIN MFG. CO., Ontario, CA (US)

( * ) Notice: Subject to any disclaimer, the term of this patent is extended or adjusted under 35 U.S.C. 154(b) by 23 days.

(21) Appl. No.: 16/984,718

(22) Filed: Aug. 4, 2020

(65) Prior Publication Data

US 2020/0361743 A1 Nov. 19, 2020

Related U.S. Application Data

(62) Division of application No. 15/913,355, filed on Mar. 6, 2018, now Pat. No. 10,730,718.

(51) Int. Cl.
*A45F 5/00* (2006.01)
*A45F 5/02* (2006.01)
(Continued)

(52) U.S. Cl.
CPC ..... *B65H 75/4439* (2013.01); *A45F 5/004* (2013.01); *A45F 5/021* (2013.01);
(Continued)

(58) Field of Classification Search
CPC ... A45F 5/004; A45F 2005/025; A01K 89/00; B60R 22/34; Y10S 224/93
See application file for complete search history.

(56) References Cited

U.S. PATENT DOCUMENTS 2,589,500 A * 3/1952 Landon ..... B25H 7/00 33/393
3,968,670 A * 7/1976 Quenot ..... A45F 5/004 70/456 R
(Continued)

FOREIGN PATENT DOCUMENTS

GB 785739 A 11/1957
WO WO 01/00055 A1 1/2001

OTHER PUBLICATIONS

International Search Report and Written Opinion for Application No. PCT/US2019/021001, dated Sep. 23, 2019, 20 pages.
(Continued)

*Primary Examiner* — Brian D Nash
(74) *Attorney, Agent, or Firm* — Lewis Roca Rothgerber Christie LLP

(57) ABSTRACT

A retractor device includes a housing including a back plate, a faceplate spaced apart from the back plate, and a sidewall extending between the back plate and the faceplate. The retractor device also includes a rotatable reel inside the housing, a spring biasing rotation of the rotatable reel in one direction, a tether wound around the rotatable reel, and an end fitting coupled to an end of the tether. A retainer of the housing is in contact with the end fitting when the end fitting is in the retracted position. The retractor device also includes at least one bearing inside the housing proximate to the retainer, and first and second extension openings in the sidewall of the housing on opposite sides of the retainer. The tether is configured to engage the bearing when the tether is extended through one of the first and second extension openings.

10 Claims, 10 Drawing Sheets

(51) Int. Cl.
*B65H 75/44* (2006.01)
*B65H 75/48* (2006.01)
*B65H 75/40* (2006.01)

(52) U.S. Cl.
CPC ..... *B65H 75/40* (2013.01); *B65H 75/4402* (2013.01); *B65H 75/446* (2013.01); *B65H 75/4471* (2013.01); *B65H 75/48* (2013.01); *B65H 75/486* (2013.01)

(56) References Cited

U.S. PATENT DOCUMENTS 4,197,656 A * 4/1980 Lane ..... B44D 3/38 33/414
4,565,011 A 1/1986 Karger
4,765,557 A * 8/1988 Kahmann ..... B44D 3/38 242/381.6
4,907,348 A 3/1990 Hubbard, Jr.
5,014,437 A * 5/1991 Sun ..... B44D 3/38 242/385.4
5,042,159 A * 8/1991 Millen ..... B65H 75/486 33/414
5,235,728 A 8/1993 Nordberg
5,509,616 A * 4/1996 Millen, Jr ..... B44D 3/38 242/381.5
5,640,922 A 6/1997 Feldkamp et al.
5,833,165 A 11/1998 Paugh
5,954,288 A * 9/1999 Shih ..... A45F 5/004 242/380
6,167,632 B1 * 1/2001 Shor ..... B44D 3/38 33/413
6,289,597 B1 * 9/2001 Beyers ..... B44D 3/38 33/414
6,626,389 B2 * 9/2003 Kagel ..... A45F 5/004 242/371
6,633,770 B1 10/2003 Gitzinger et al.
7,007,882 B2 3/2006 Raia et al.
7,380,357 B2 * 6/2008 Jones ..... A44C 3/001 40/1.5
8,191,815 B2 * 6/2012 Huang ..... B65H 75/48 242/379
8,746,519 B2 * 6/2014 Young ..... A45F 5/004 224/162
9,161,115 B2 10/2015 Schrems et al.
9,451,821 B1 9/2016 Estigoy
10,730,718 B2 * 8/2020 Castaneda ..... B65H 75/4471
2002/0148078 A1 10/2002 Salentine et al.
2003/0042348 A1 3/2003 Salentine et al.
2004/0035897 A1 2/2004 Salentine et al.
2004/0089759 A1 * 5/2004 Genuise ..... A45F 5/004 242/379
2010/0206976 A1 8/2010 Salentine et al.
2011/0174852 A1 7/2011 Young et al.
2015/0197973 A1 7/2015 Day
2017/0215293 A1 7/2017 Merenda
2017/0231375 A1 8/2017 Moreau et al.

OTHER PUBLICATIONS

Invitation to Pay Additional Fees for Application No. PCT/US2019/021001, dated May 22, 2019, 16 pages.

* cited by examiner

AMBIDEXTURAL RETRACTING REEL AND DEVICE SECURABLE TO AN ARTICLE

CROSS-REFERENCE TO RELATED APPLICATION

This application is a divisional of U.S. patent application Ser. No. 15/913,355, filed Mar. 6, 2018, the entire contents of which are incorporated herein by reference.

FIELD

The present disclosure relates generally to retractable reel devices and devices securable to an article worn by a user.

BACKGROUND

Retractor devices are commonly utilized to secure one or more items, such as a set of keys or an access key card, in a readily accessible position, such as on the user's belt. Conventional retractor devices include a housing, a spring-loaded reel inside the housing, and a cable or chain wound around the spring-loaded reel. The one or more items (e.g., keys) are secured to an end of the cable or chain. The one or more items may be extended away from the user's person (e.g., to unlock a door) by grasping on the items and/or the end of the cable or chain and pulling with sufficient force to overcome the biasing force of the spring-loaded reel. The spring-loaded reel is configured to retract and rewind the cable or chain around the reel when the user stops applying sufficient force, such as by releasing the item and/or the end of the cable or chain.

However, many conventional retractor devices are configured for ergonomic use only by right-hand dominant users. For instance, some conventional retractor devices are configured to be worm on the user's right hip and then grasped with the user's right to extend the cable or chain and the one or more items connected to the end of the cable or chain away from the housing. Use of these conventional retractor device by left-hand dominants user may be cumbersome.

Additionally, many conventional retractor devices are prone to being inadvertently dislodged from the user's belt or other article to which the retractor device is attached.

SUMMARY

The present disclosure is directed to various embodiments of a retractor device. In one embodiment, the retractor device includes a housing including a back plate, a faceplate spaced apart from the back plate, and at least one sidewall extending between the back plate and the faceplate. The retractor device also includes a rotatable reel inside the housing, a spring biasing rotation of the rotatable reel in one direction, and a tether at least partially wound around the rotatable reel. The tether includes a first end coupled to the rotatable reel and a second end opposite the first end. The retractor device also includes an end fitting coupled to the second end of the tether. The end fitting includes an enlarged inner end having a width. The end fitting and the tether are configured to move between a retracted position, a deployed position, and an extended position. A retainer of the housing is in contact with the end fitting when the end fitting is in the retracted position. The retractor device also includes at least one bearing inside the housing proximate to the retainer, and first and second extension openings defined in the sidewall of the housing on opposite sides of the retainer. The end fitting is configured to be selectively moved into the deployed position in one of the first and second extension openings and the tether is configured to extend through one of the first and second extension openings in the extended position. The tether is configured to engage the bearing when the tether is extended through one of the first and second extension openings in the extended position.

The at least one bearing may be a freely rotatable bearing configured to rotate about an axis substantially perpendicular to the back plate and the faceplate of the housing. The at least one bearing may include a pair of bearings. The at least one bearing 136 may be laterally off-center on the housing.

The first and second extension openings may each include a pass-through portion proximate to the retainer having a width at least as large as a width of the enlarged inner end of the end fitting, and an elongated portion extending from the pass-through portion along the at least one sidewall away from the retainer having a width at least as large as a width of the tether and smaller than the width of the enlarged inner end of the end fitting.

The end fitting may also include an enlarged outer end and a stem extending between the enlarged inner end and the enlarged outer end. The retractor device may include a connector coupled to the enlarged outer end of the end fitting.

The retainer may include a slot in the at least one sidewall of the housing, and the stem of the end fitting may be received in the slot when the end fitting is in the retracted position.

The retractor device may also include a first pair of stops extending into the slot and a second pair of stops extending into the slot. The first and second pairs of stops may be on opposite sides of the stem when the end fitting is in the retracted position. A distance between the stops in each of the first and second pair of stops may be less than a width of the stem.

The present disclosure is also directed to various embodiments of a device. In one embodiment, the device includes a housing, and a belt clip coupled to an exterior surface of the housing. The belt clip includes an inner leg on the exterior surface and an outer leg connected to the inner leg. The outer leg includes an inwardly-turned segment and an outwardly-turned segment connected to the inwardly-turned segment. The inwardly-turned segment and the outwardly-turned segment together define a catch. The device also includes a locking member hingedly coupled to the exterior surface of the housing. The locking member is configured to rotate between a stowed position and a locked position engaging the belt clip. When the locking member is in the locked position, a portion of the locking member is received in the catch.

The device may include a recess defined in the exterior surface of the housing. The recess is configured to accommodate at least a portion of the locking member in the stowed position.

The device may include at least one notch defined in a sidewall of the housing that opens up into the recess.

The locking member may be a square-shaped ring.

The belt clip may include an engagement member on the outwardly-turned segment extending into the catch. When the locking member is in the locked position, engagement between the portion of the locking member and the engagement member is configured to retain the locking member in the locked position. The engagement member may be a ridge extending transversely across the belt clip.

The belt clip may also include a lip extending from an outer end of the outwardly-turned segment of the outer leg.

The lip may be angled relative to the outwardly-turned segment away from the catch.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a retractor device. The retractor device is configured to tether and releasably secure one or more objects, such as keys, key cards and/or a small tool or device, to a user's person (e.g., an article worn by the user, such as a belt, waistband, or strap) with a retractable tether. The retractor device is configured to allow the user to extend the one or more objects and the retractable tether from a retracted position close to the user's body into an extended position away from the user's body (e.g., to unlock a door with a key, swipe a key card at a card reader and/or point a flashlight to illuminate an object) and to return the one or more objects into the retracted position. Additionally, the retractor device according to one or more embodiments of the present disclosure is configured to be used ergonomically by both left-hand-dominant and right-hand-dominant users.

The present disclosure is also directed to various embodiments of a device including a belt clip for securing the device to a user's person (e.g., an article worn by the user, such as a belt, waistband, or strap). The belt clip is configured to be releasably locked in a closed configuration with a releasable locking member to prevent the device from inadvertently disengaging the user's person. The locking member is also configured to be moved into a stowed position to permit the device to be readily detached from the user's person.

Figure 1:
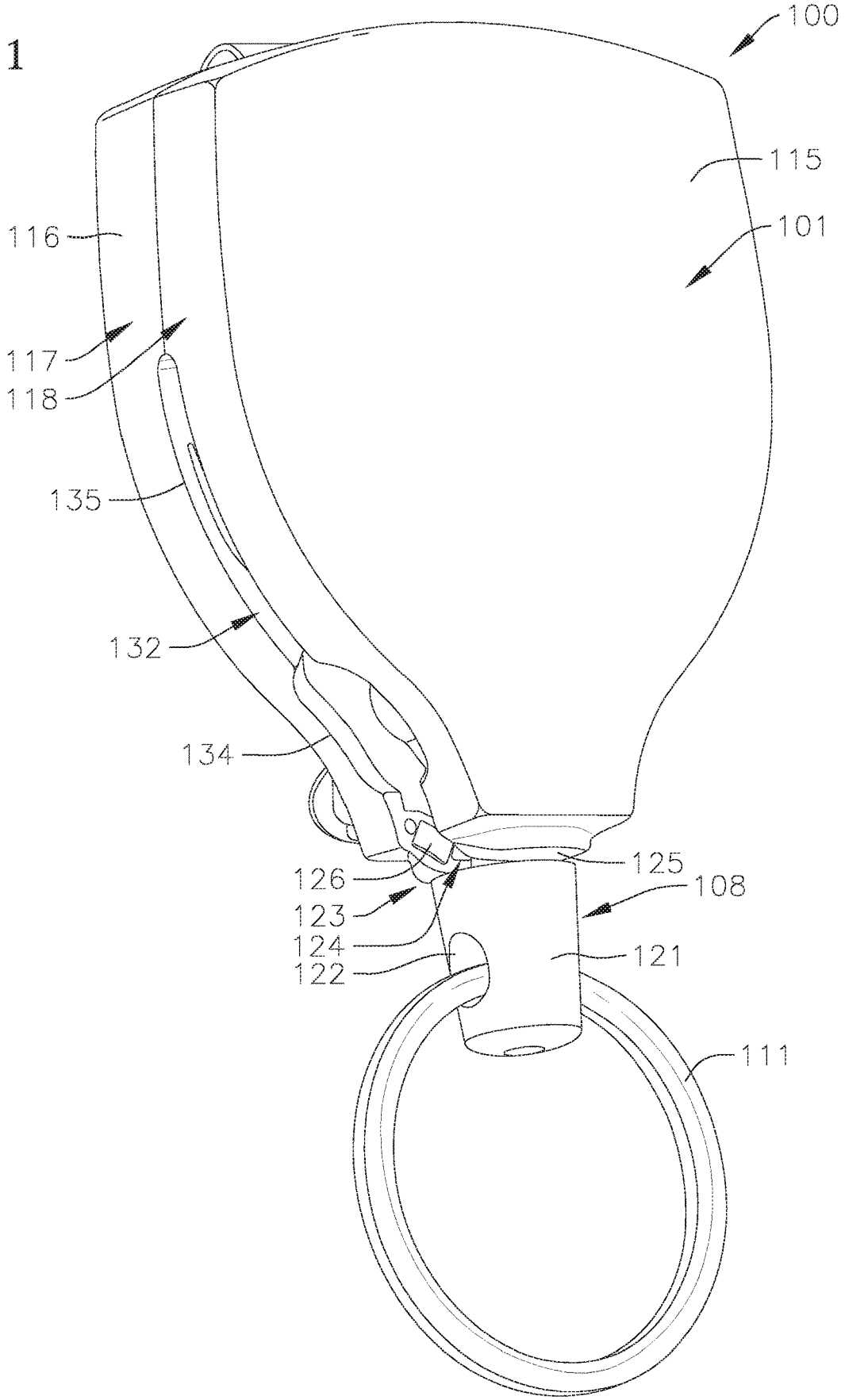
FIG. 1 is a front perspective view of a retractor device according to one embodiment of the present disclosure.
Figure 2A:
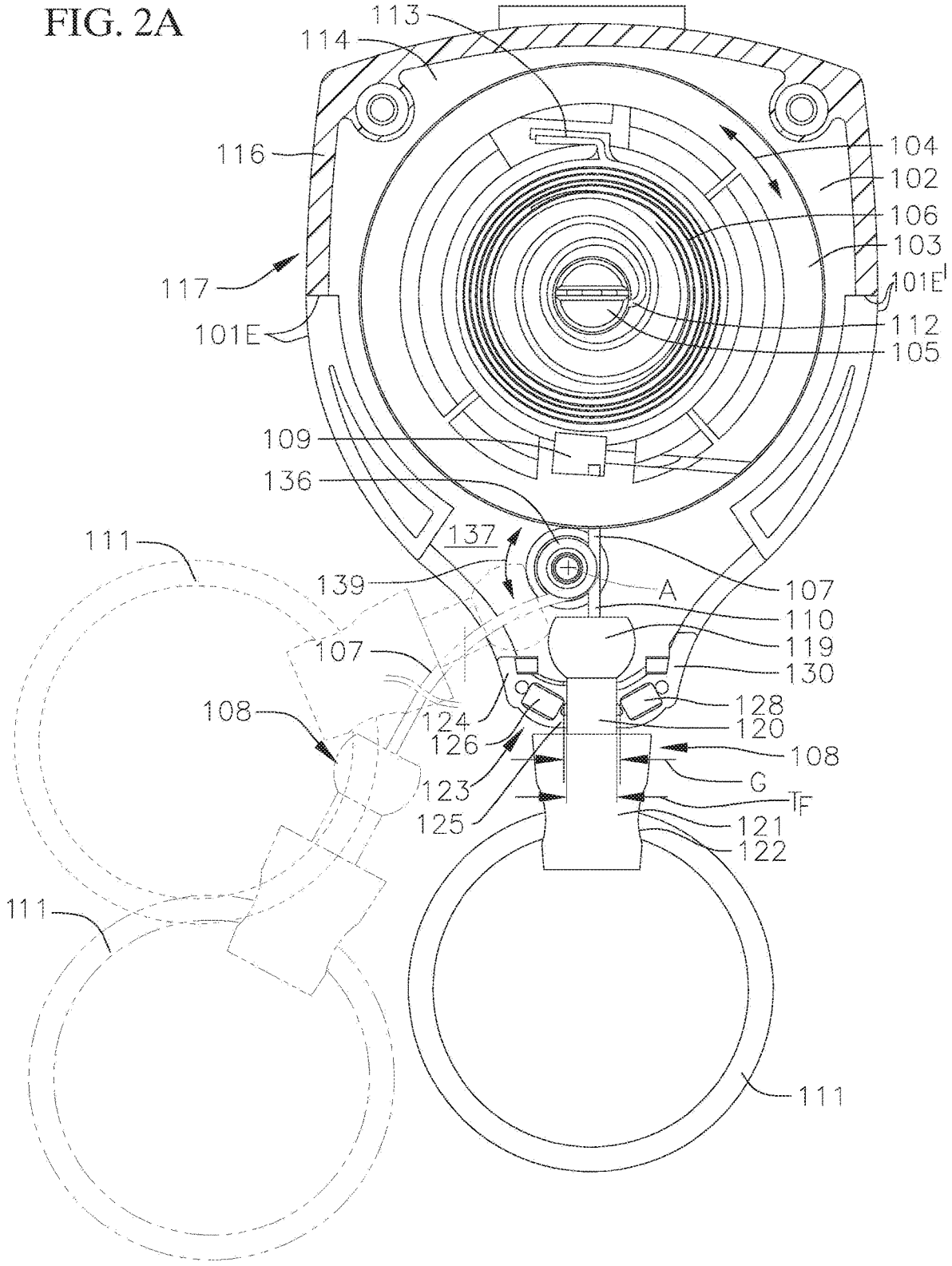
FIG. 2A is a front view of the embodiment of the retractor device illustrated in FIG. 1 with a front portion of the housing omitted to reveal interior components of the retractor device.
Figure 2B:
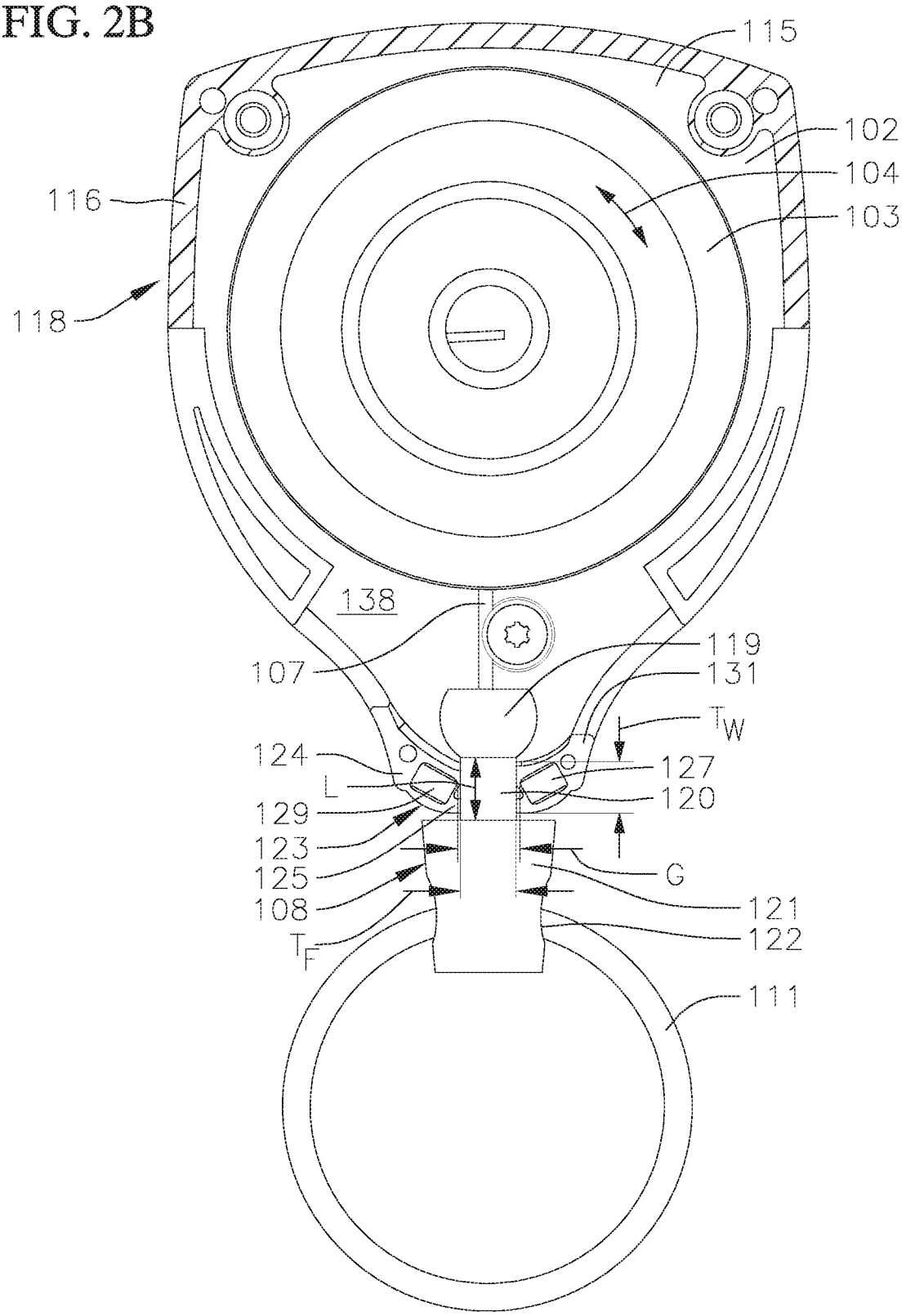
FIG. 2B is a rear view of the embodiment of the retractor device illustrated in FIG. 1 with a back portion of the housing omitted.

With reference now to FIGS. 1 and 2A-2B, a retractor device 100 according to one embodiment of the present disclosure includes a housing 101 defining an interior chamber 102, a reel 103 rotatably (arrow 104) housed in the interior chamber 102 about a post 105, a spring 106 (e.g., a coil spring) housed in the interior chamber 102, a tether 107 at least partially wound around the reel 103, and an end fitting 108 coupled to the tether 107. In the illustrated embodiment, a first end 109 of the tether 107 is coupled to the reel 103 and a second end 110 of the tether 107 opposite the first end 109 is coupled to the end fitting 108 (e.g., by a knot formed at the second end 110 of the tether 107). Additionally, in the illustrated embodiment, the retractor device 100 includes a connector 111 (e.g., a key ring) coupled to the end fitting 108, although in one or more embodiments the retractor device 100 may be provided without the connector 111. In the illustrated embodiment, one end 112 of the spring 106 is coupled to the post 105 and an opposite end 113 of the spring 106 is coupled to the reel 103. The end fitting 108 and the tether 107 are configured to move between a retracted position (shown in solid lines) in which the tether 107 is wound around the reel 103 to the full extent, a deployed position in which the end fitting 108 is not secured in the retracted position (shown in dashed lines in FIG. 2A), or an extended position (also shown in dashed lines in FIG. 2A) in which the end fitting 108 is not secured in the retracted position and a portion of the tether 107 is extended outside of the interior chamber 102 of the housing 101 and the end fitting 108 is spaced apart from the housing 101. The spring 106 is configured to bias the reel 103 to rewind (arrow 104) the tether 107 into the housing 101 around the reel 103 and thereby move the tether 107 and the end fitting 108 into the retracted position. The tether 107 and the end fitting 108 may be moved into the extended position by the user pulling on the end fitting 108 with sufficient force to overcome the biasing force of the spring 106.

In the illustrated embodiment, the housing 101 includes a back plate 114, a faceplate 115 spaced apart from the back plate 114, and at least one sidewall 116 extending between the back plate 114 and the faceplate 115 and around outer peripheries of the back plate 114 and the faceplate 115. In the illustrated embodiment, the housing 101 includes a first housing member 117 (e.g., a first housing half) and a second housing member 118 (e.g., a second housing half) coupled to the first housing member 117. In the illustrated embodiment, the first housing member 117 includes the back plate 114, the second housing member 118 includes the faceplate 115, and the first and second housing members 117, 118 cooperate to form the at least one sidewall 116. In one or more embodiments, the housing 101 may include any other suitable number of components, such as a single component or more than two components. Additionally, in one or more embodiments, the first and second housing members 117, 118 may be welded together (e.g., by friction stir welding) to form a monolithic housing 101. Additionally, in the illustrated embodiment, the housing 101 is generally shield-shaped, although in one or more embodiments, the housing 101 may have any other suitable shape, such as, for instance, a circular shape. Although in the illustrated embodiment the back plate 114 and the faceplate 115 are generally flat (e.g., generally planar), in one or more embodiments the back plate 114 and/or the faceplate 115 may be non-planar (e.g., curved).

In the embodiment illustrated in FIGS. 2A-2B the end fitting 108 includes an enlarged inner end 119 (e.g., a ball or a truncated ball), a stem 120 extending outward from the enlarged inner end 119, and an enlarged outer end 121 connected to the stem 120. In the illustrated embodiment, the enlarged inner and outer ends 119, 121 are at opposite ends of the stem 120. The enlarged outer end 121 defines a transverse opening 122. In the illustrated embodiment, the connector 111 (e.g., a key ring) is connected to the end fitting 108 by extending through the transverse opening 122 in the enlarged outer end 121 of the end fitting 108.

With reference now to the embodiment illustrated in FIGS. 2A-2B and 3A-3B, the housing 101 includes a retainer 123 configured to retain the end fitting 108 in the retracted position (shown in solid lines) until a user desires to extend the end fitting 108 away from the housing 101 into the deployed position (shown in dashed lines) (e.g., the retainer 123 of the housing 101 is configured to prevent the end fitting 108 and the tether 107 from inadvertently moving into the deployed position). In the illustrated embodiment, the retainer 123 includes a slot 124 (see also FIG. 1) in the sidewall 116 of the housing 101. In one or more embodiments, the width $T_s$ of the slot 124 is the same or substantially the same as the width $T_f$ (e.g., diameter) of the stem 120 of the end fitting 108. Additionally, in the illustrated embodiment, the wall thickness $T_w$ of the sidewall 116 at the retainer 123 is the same or substantially the same as the length L of the stem 120 of the end fitting 108. In one or more embodiments, the retainer 123 may include a boss 125 (see FIG. 1) extending outward from the sidewall 116 at the retainer 123, and a combined thickness of the sidewall 116 and the boss 125 at the retainer 123 is the same or substantially the same as the length L of the stem 120 of the end fitting 108. When the end fitting 108 is in the retracted position, as shown in solid lines in FIGS. 2A-2B, the enlarged inner end 119 and the enlarged outer end 121 of the end fitting 108 are on opposite sides of the sidewall 116 of the housing 101 (i.e., the enlarged inner end 119 of the end fitting 108 is inside the interior chamber 102 of the housing 101 and the enlarged outer end 121 of the end fitting 108 is outside the interior chamber 102 of the housing 101). In the illustrated embodiment, the size (e.g., diameter) of the enlarged inner end 119 of the end fitting 108 is greater than the width $T_s$ of the slot 124 such that the end fitting 108 cannot move into the deployed position when the end fitting 108 is in the retracted position and retained in the retainer 123. Additionally, in the illustrated embodiment, the size of the enlarged outer end 121 of the end fitting 108 is greater than the width $T_s$ of the slot 124, which prevents the end fitting 108 from retracting completely into the interior chamber 102 of the housing 101.

With continued reference to the embodiment illustrated in FIGS. 2A-2B and 3A-3B, the retainer 123 also includes a first pair of opposing stops 126, 127 and a second pair of opposing stops 128, 129 on first and second surfaces 130, 131 of the sidewall 116 facing the slot 124. The first and second pairs of opposing stops 126-129 extend from the first and second surfaces 130, 131 into the slot 124. In this manner, the stops 126-129 effectively narrow the width $T_s$ of the slot 124 in the housing 101 at the locations of the stops 126-129. The stops 126, 128 on the first surface 130 and the stops 127, 129 on the second surface 131 are spaced apart from each other by a gap G at least as large as the width $T_f$ (e.g., diameter) of the stem 120 of the end fitting 108. In the embodiment illustrated in FIGS. 3A-3B, the distance D between each of the stops 126, 128 on the first surface 130 and each corresponding stop 127, 129 on the second surface 131 is less than the width $T_f$ (e.g., diameter) of the stem 120 of the end fitting 108. When the end fitting 108 is in the retracted position and is retained in the retainer 123, the stem 120 of the end fitting 108 is positioned in the slot 124 between the first pair of stops 126, 127 and the second pair of stops 128, 129. Accordingly, the first and second pairs of stops 126-129 create an interference with the stem 120 of the end fitting 108 that must be overcome before the end fitting 108 and the tether 107 can be moved into the extended position. In this manner, the stops 126-129 are configured to retain the end fitting 108 in the slot 124 and prevent the end fitting 108 and the tether 107 from being inadvertently extended from the housing 101. As described in more detail below, the user may move the end fitting 108 and the tether 107 into the deployed position by first moving the end fitting 108 into a deployed position by either passing the stem 120 of the end fitting 108 between and past the first pair of opposing stops 126, 127 or by passing the stem 120 between and past the second pair of opposing stops 128, 129, depending, for instance, on the handedness of the user (e.g., depending on whether the user is left-hand-dominant or right-hand-dominant).

Figure 3A:
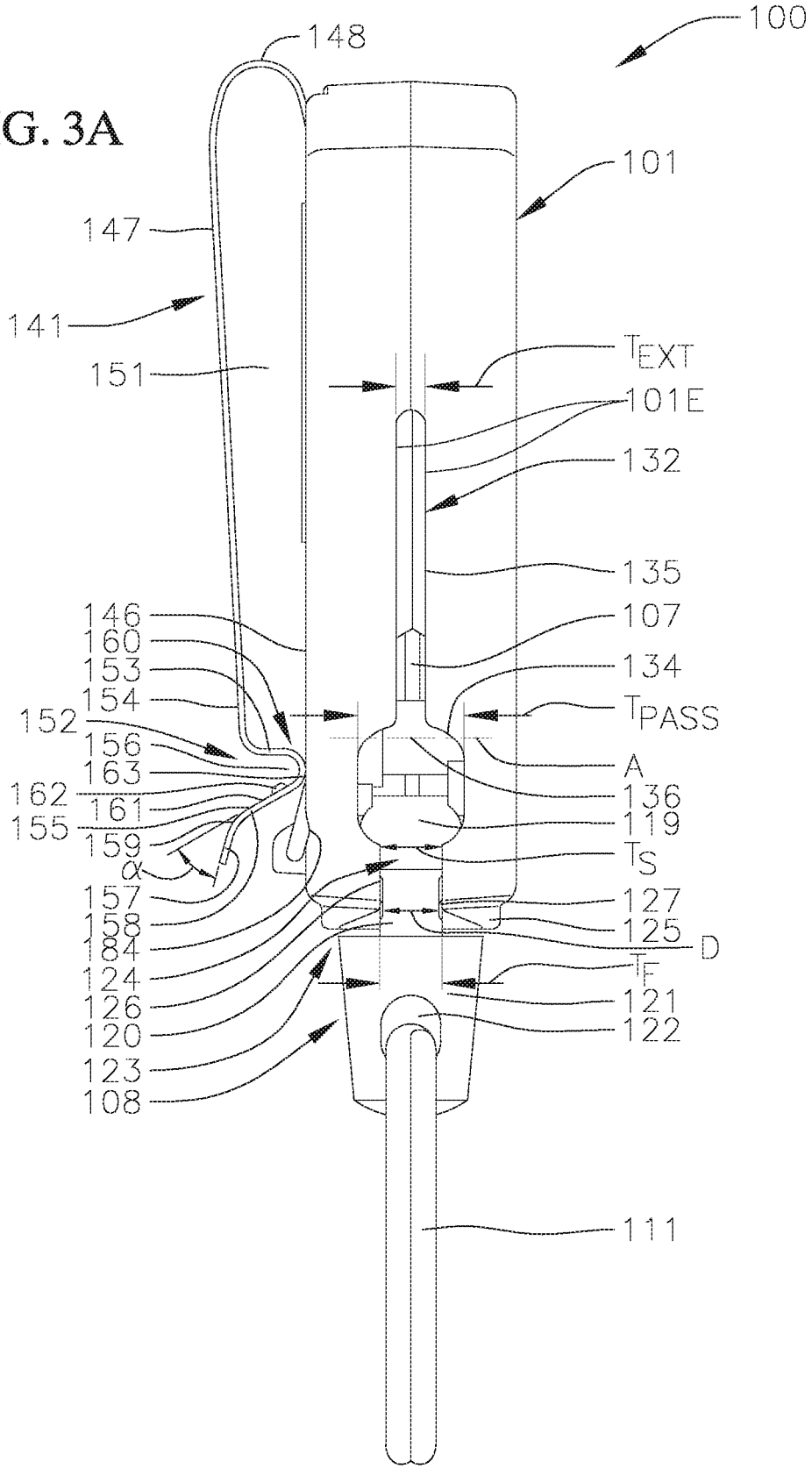
FIGS. 3A-3B are a left side view and a right side view, respectively, of the embodiment of the retractor device illustrated in FIG. 1.
Figure 3B:
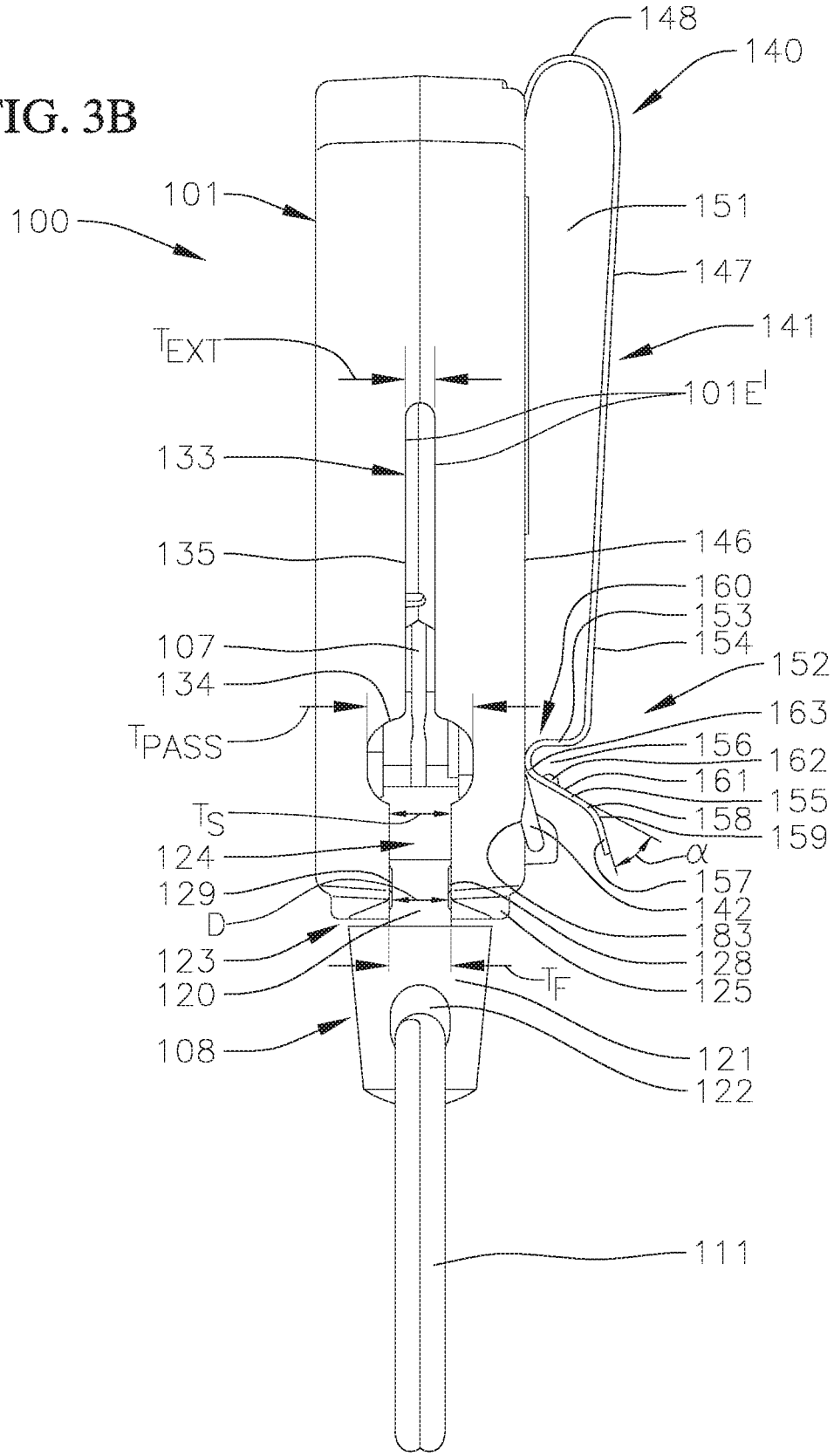

With continued reference to the embodiment illustrated in FIGS. 3A-3B, the retractor device 100 also includes a first extension opening 132 (FIG. 3A) and a second extension opening 133 (FIG. 3B) defined in the sidewall 116 of the housing 101. The first and second extension openings 132, 133 are on opposite sides of the retainer 123. In the illustrated embodiment, the first and second extension openings 132, 133 are symmetric about a centerline of the housing 101. The first and second extension openings 132, 133 each include an end fitting pass-through portion 134 and an elongated extension portion 135 extending from the end fitting pass-through portion 134. The end fitting pass-through portions 134 of the first and second extension openings 132, 133 are proximate to the slot 124 of the retainer 123 and the elongated extension portions 135 extend along the sidewall 116 from the end fitting pass-through portions 134 away from the slot 124. In the illustrated embodiment, the width $T_{pass}$ of the end fitting pass-through portions 134 is at least as large (e.g., larger) than the enlarged inner end 119 of the end fitting 108 but smaller than the enlarged outer end 121 of the end fitting 108. Additionally, in the illustrated embodiment, the width $T_{ext}$ of the elongated extension portions 135 of the extension openings 132, 133 is smaller (e.g., narrower) than the end fitting pass-through portions 134, but larger than the size (e.g., diameter) of the tether 107.

In operation, a user may deploy and extend the end fitting 108 and the tether 107 from the housing 101 by first moving the end fitting 108 from the retracted position in which the end fitting 108 is retained by the retainer 123 to the deployed position in which the end fitting 108 is received in the end fitting pass-through portion 134 of one of the extension openings 132, 133. The end fitting 108 may be moved into the deployed position by pressing the end fitting 108 with sufficient force to cause the stem 120 of the end fitting 108 to pass between and past either the first pair of opposing stops 126, 127 or the second pair of opposing stops 128, 129 (i.e., sufficient force to overcome the interference between either the first or second pair of opposing stops 126-129 and the stem 120 of the end fitting 108) such that the stem 120 of the end fitting 108 exits the slot 124 and moves into the end fitting pass-through portion 134 of one of the extension openings 132, 133. When the end fitting 108 is in the deployed position (e.g., the end fitting 108 is in one of the end fitting pass-through portions 134), the end fitting 108 and the tether 107 may be extended away from the housing 101 into the extended position because the end fitting pass-through portions 134 of the extension openings 132, 133 are larger than the enlarged inner end 119 (e.g., the ball) of the end fitting 108.

In one or more embodiments, the extension opening 132, 133 that is utilized to deploy and extend the end fitting 108 and the tether 107 from the housing 101 into the extended position may depend on the handedness of the user. For instance, in one or more embodiments, a right-handed user may choose to wear the retractor device 100 on his right hip. In such a location, the right-handed user may move the end fitting 108 into the deployed position by grasping the end fitting 108, the connector 111, and/or an item (e.g., a key card or keys) connected to the connector 111 with his right hand and then moving the end fitting 108 into the end fitting pass-through portion 134 of the extension opening 133 that faces the toward the front of the user's body. The end fitting 108, the connector 111, and the tether 107 may then be extended into the extended position in front of the user by pulling with sufficient force to overcome the biasing force of the spring 106 coupled to the reel 103.

In contrast, a left-handed user may choose to wear the retractor device 100 on his left hip. When the retractor device 100 is worn on the user's left hip, the left-handed user may move the end fitting 108 into the deployed position by grasping the end fitting 108, the connector 111, and/or an item (e.g., a key card or keys) connected to the connector 111 with his left hand and then moving the end fitting 108 into the pass-through portion 134 of the opposite extension opening 132 (i.e., the extension opening 132 that faces toward the front of the user's body). The user may then extend the end fitting 108, the connector 111, and the tether 107 into the extended position in front of the user with the user's left hand by pulling with sufficient force to overcome the biasing force of the spring 106 coupled to the reel 103. In this manner, the opposing extension openings 132, 133 in the housing 101 enable the retractor device 100 to be ergonomically used by both left-hand-dominant users and right-hand-dominant users (i.e., the opposing extension openings 132, 133 are configured to enable ergonomic, ambidextural use of the retractor device 100).

The elongated extension portions 135 of the extension openings 132, 133 are configured to accommodate the tether 107. For instance, if the user pulls the end fitting 108, the connector 111, and/or any item connected to the connector 111 upward relative to the housing 101 (e.g., upward toward the user's face) after the end fitting 108 has passed through one of the end fitting pass-through portions 134, the tether 107 will move up into the corresponding elongated extension portion 135. In this manner, the elongated extension portions 135 are configured to prevent or at least reduce contact between the tether 107 and the sidewall 116 of the housing 101 along the length of the elongated extension portion 135, which might otherwise prematurely wear (e.g., fray) the tether 107. Additionally, if the user pulls the end fitting 108, the connector 111, and/or any item connected to the connector 111 sufficiently upward relative to the housing 101 such that the tether 107 reaches the end of the elongated extension portion 135 distal to the end fitting pass-through portion 134, the contact angle between the tether 107 and the sidewall 116 of the housing 101 is smaller (e.g., more acute) than the contact angle would be if the housing 101 did not include the elongated extension portion 135. This reduction in the contact angle between the tether 107 and the sidewall 116 of the housing 101 is configured to reduce the abrasion of the tether 107 caused by contact between the tether 107 and the sidewall 116 of the housing 101.

With reference again now to the embodiment illustrated in FIG. 2A, the retractor device 100 also includes a bearing 136 inside the interior chamber 102 of the housing 101 extending between interior surfaces 137, 138 of the back plate 114 and the faceplate 115 (see FIG. 2B). In the illustrated embodiment, a lengthwise direction of the bearing 136 and its axis of rotation A are perpendicular or substantially perpendicular to the interior surfaces 137, 138 of the back plate 114 and the faceplate 115. In one or more embodiments, the bearing 136 is a freely rotatable bearing rotatable (arrow 139) about the axis of rotation A. In the illustrated embodiment, the bearing 136 is non-translational relative to the housing 101 (i.e., the position of the bearing 136 is configured not to move within the interior chamber 102 of the housing 101). In the illustrated embodiment, the bearing 136 is positioned between the reel 103 and the slot 124 in the sidewall 116 of the housing 101 and serves as a pivot for the tether 107.

Additionally, in one or more embodiments, the bearing 136 is laterally off-center (e.g., offset from the centerline of the housing 101) and is positioned closer to one of the extension openings 132, 133 than the other extension opening 132, 133. In one or more embodiments, the direction in which the bearing 136 is offset from center depends on the direction in which the tether 107 is wound around the reel 103. In the illustrated embodiment, the tether 107 is wound counter-clockwise around the reel 103 (when viewing the interior surface 137 of the back plate 114, as shown in FIG. 2A), and the bearing 136 is offset toward the extension opening 132 (see FIG. 3A) (e.g., the extension opening 132 to the left of the reel 103 and utilized by a left-hand-dominant user). In one or more embodiments, the tether 107 may be wound clockwise around the reel 103 and the bearing 136 may be offset toward the other extension opening 133 to the right of the reel 103 and (e.g., the extension opening 133 utilized by right-hand-dominant users).

When the tether 107 is wound counterclockwise around the reel 103 and the tether 107 is extended out of the extension opening 132 (e.g., the extension opening 132 utilized by left-hand-dominant users), the tether 107 tangents off the reel 103 at approximately the 9 o'clock position, as illustrated in FIG. 2A. When the tether 107 tangents off the reel 103 at the 9 o'clock position, the tether 107 is proximate to the sidewall 116 of the housing 101 and the extension of the end fitting 108 and the tether 107 out of the extension opening 132 (e.g., the extension opening 132 utilized by left-hand-dominant users) would tend to cause the tether 107 to contact a housing edge 101E that surrounds and defines the extension opening 132. However, in the illustrated embodiment, when the end fitting 108 is moved into the deployed position by extending the end fitting 108 through the left-handed extension opening 132 (e.g., by a left-handed user), the tether 107 extends around and engages the bearing 136. In one or more embodiments, the engagement between the tether 107 and the bearing 136 rotates (arrow 139) the bearing 136 about the axis of rotation A of the bearing 136 as the end fitting 108 and the tether 107 are extended out of the extension opening 132. The engagement between the tether 107 and the bearing 136 is configured to prevent contact between the tether 107 and the housing edge 101E when the tether 107 is wound counterclockwise around the reel 103 and the end fitting 108 is extended through the left-handed extension opening 132, which might otherwise cause premature wear and failure of the tether 107. Additionally, in one or more embodiments, the rotation (arrow 139) of the bearing 136 is configured to minimize or reduce friction between the tether 107 and the bearing 136, which might otherwise prematurely wear the tether 107.

In contrast, when the tether 107 is wound counterclockwise around the reel 103 and the tether 107 is extended out of the other extension opening 133 (e.g., the extension opening 133 to the right of the reel 103 and utilized by right-hand-dominant users), the tether 107 tangents off the reel 103 in approximately the 6 o'clock position (e.g., a portion of the reel 103 proximate to the retainer 123) without a tendency to contact a housing edge 101E' that defines and surrounds the extension opening 133. When the tether 107 tangents off the reel 103 in the 6 o'clock position, the extension of the end fitting 108 and the tether 107 out of the extension opening 133 (e.g., the extension opening 133 utilized by right-hand-dominant users) does not tend to cause the tether 107 to contact the housing edge 101E', as illustrated in FIG. 2A. Accordingly, in the illustrated embodiment, the tether 107 does not engage the bearing 136 when the end fitting 108 is extended through the right-handed extension opening 133 because this engagement is not required to prevent contact between the tether 107 and the housing edge 101E'.

In one or more embodiments, the retractor device 100 may include a pair of bearings 136 and the tether 107 may extend between the pair of bearings 136 such that the tether 107 engages at least one of the bearings 136 when the end fitting 108 is extended through either the left-handed extension opening 132 or the right-handed extension opening 133. In one or more embodiments in which the retractor device 100 includes a pair of bearings 136, the pair of bearings 136 may be laterally centered on the housing 101 (e.g., the pair of bearings 136 may be symmetric about the centerline of the housing 101) with the tether 107 extending between the pair of bearings.

Figure 4A:
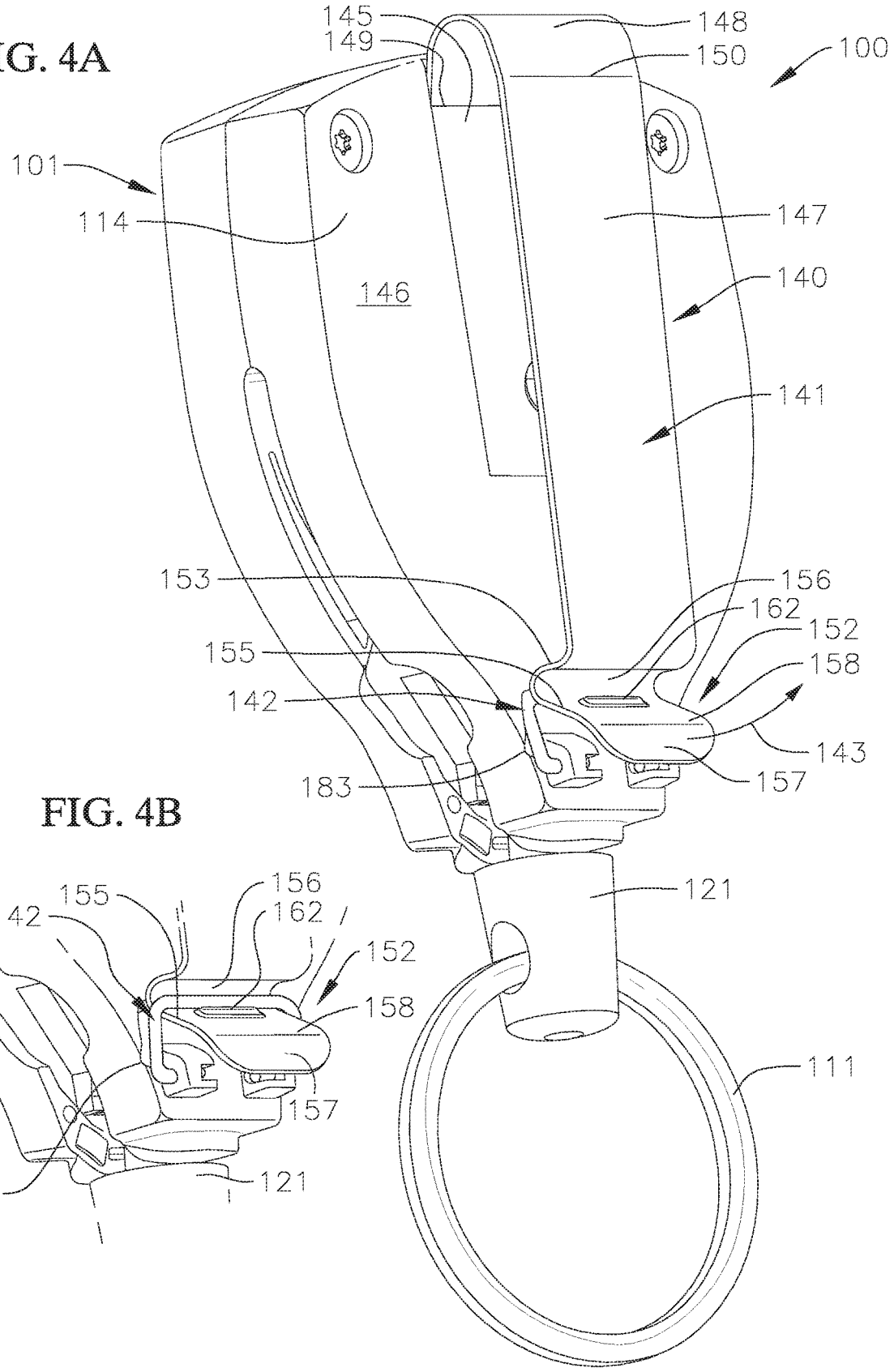
FIGS. 4A-4B are a rear perspective view and a rear perspective detail view, respectively, of the embodiment of the retractor device illustrated in FIG. 1.
Figure 4B:
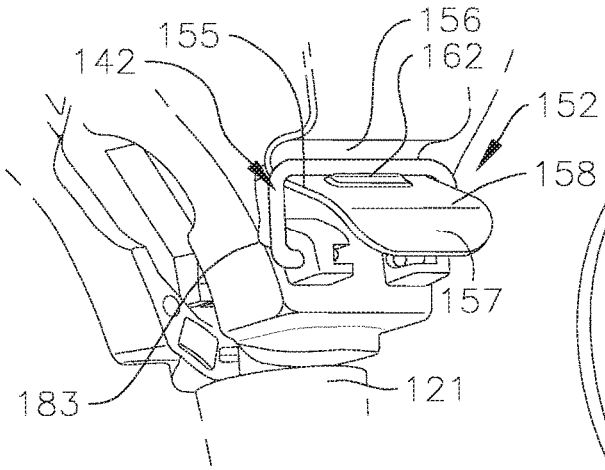
Figure 5:
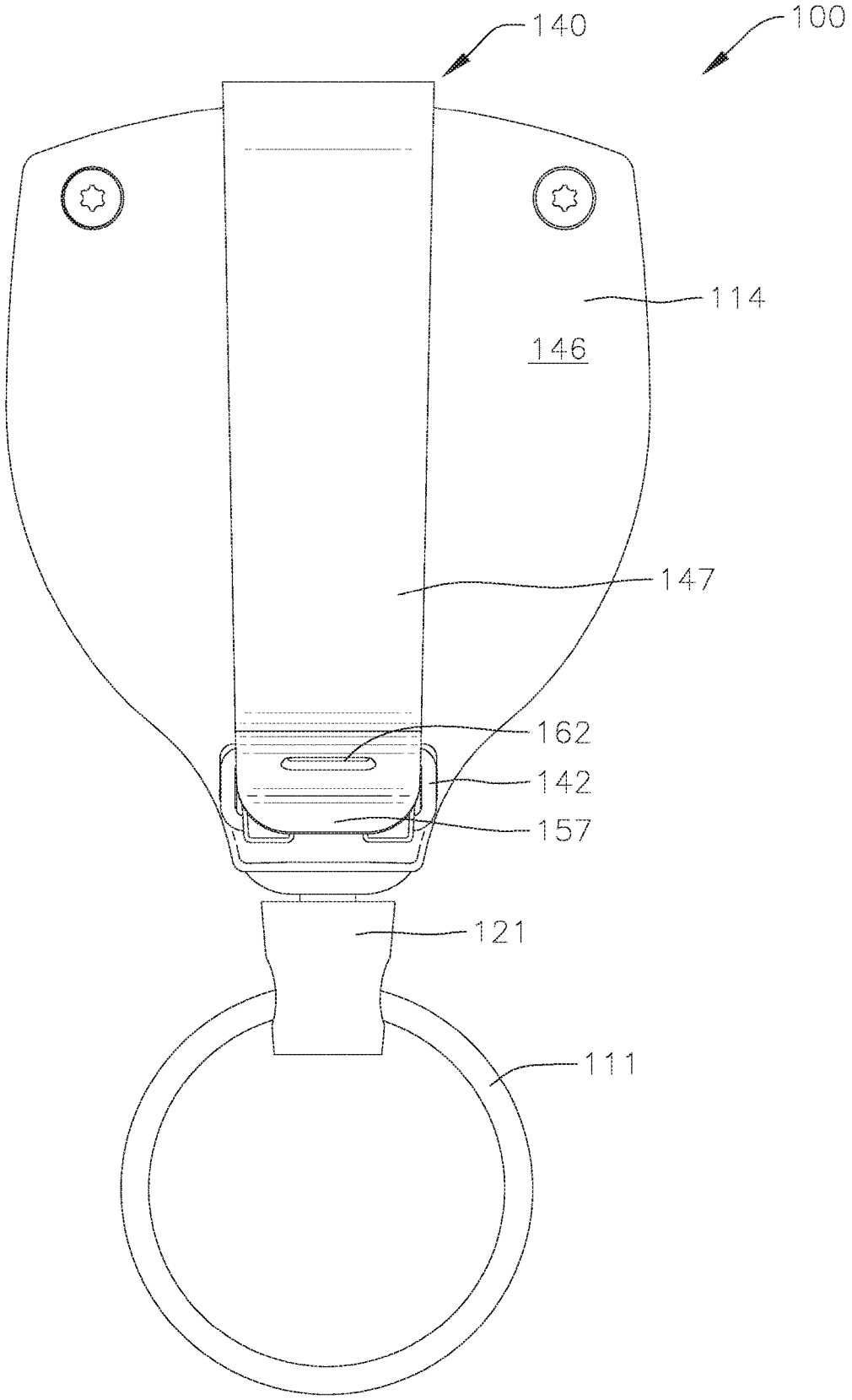
FIG. 5 is a back view of the embodiment of the retractor device illustrated in FIG. 1.
Figure 6A:
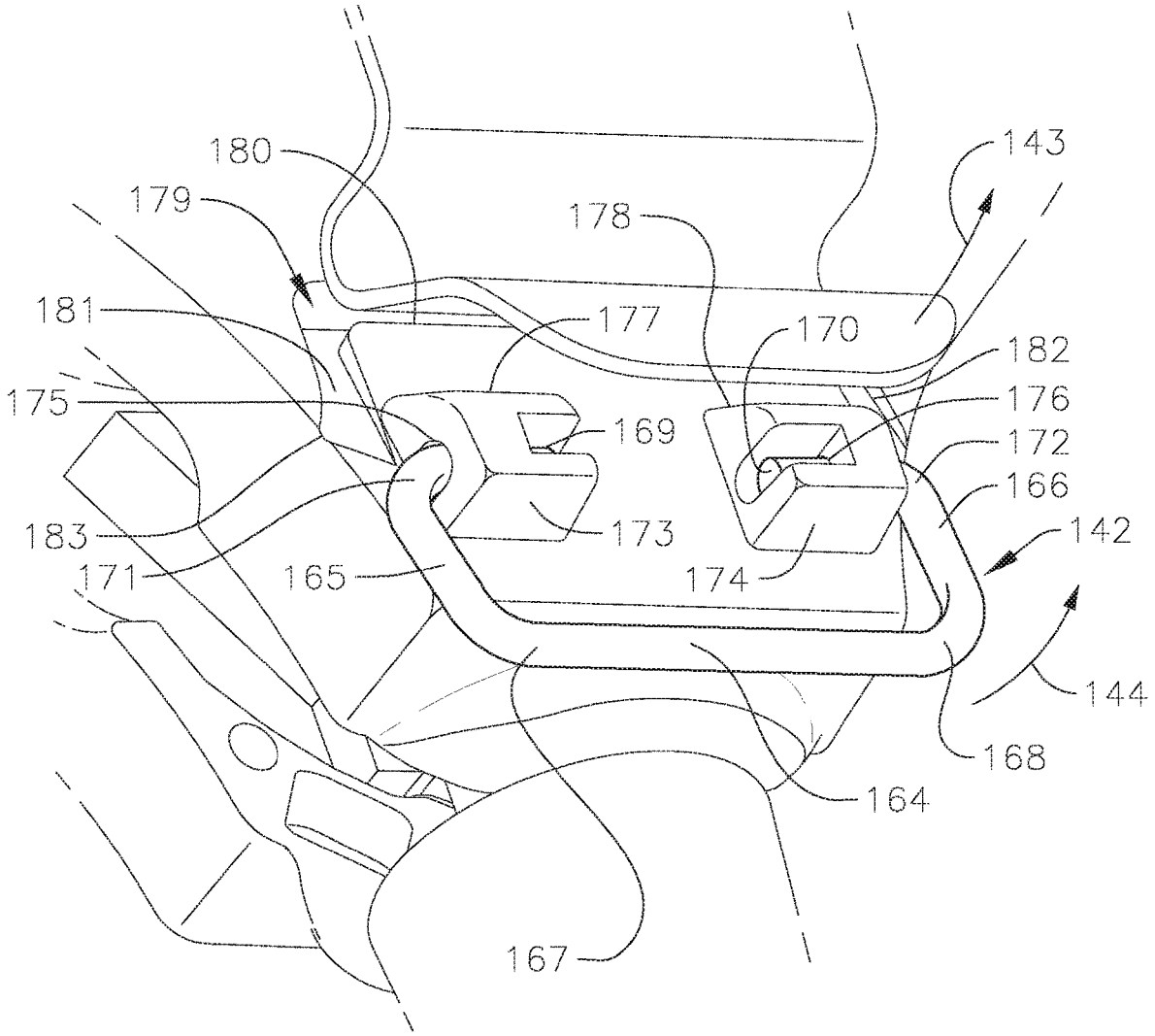
FIGS. 6A-6C are rear perspective detail views of the embodiment of the retractor device illustrated in FIG. 1 depicting a locking member in a disengaged position, an engaged position, and a stowed position, respectively.
Figure 6B:
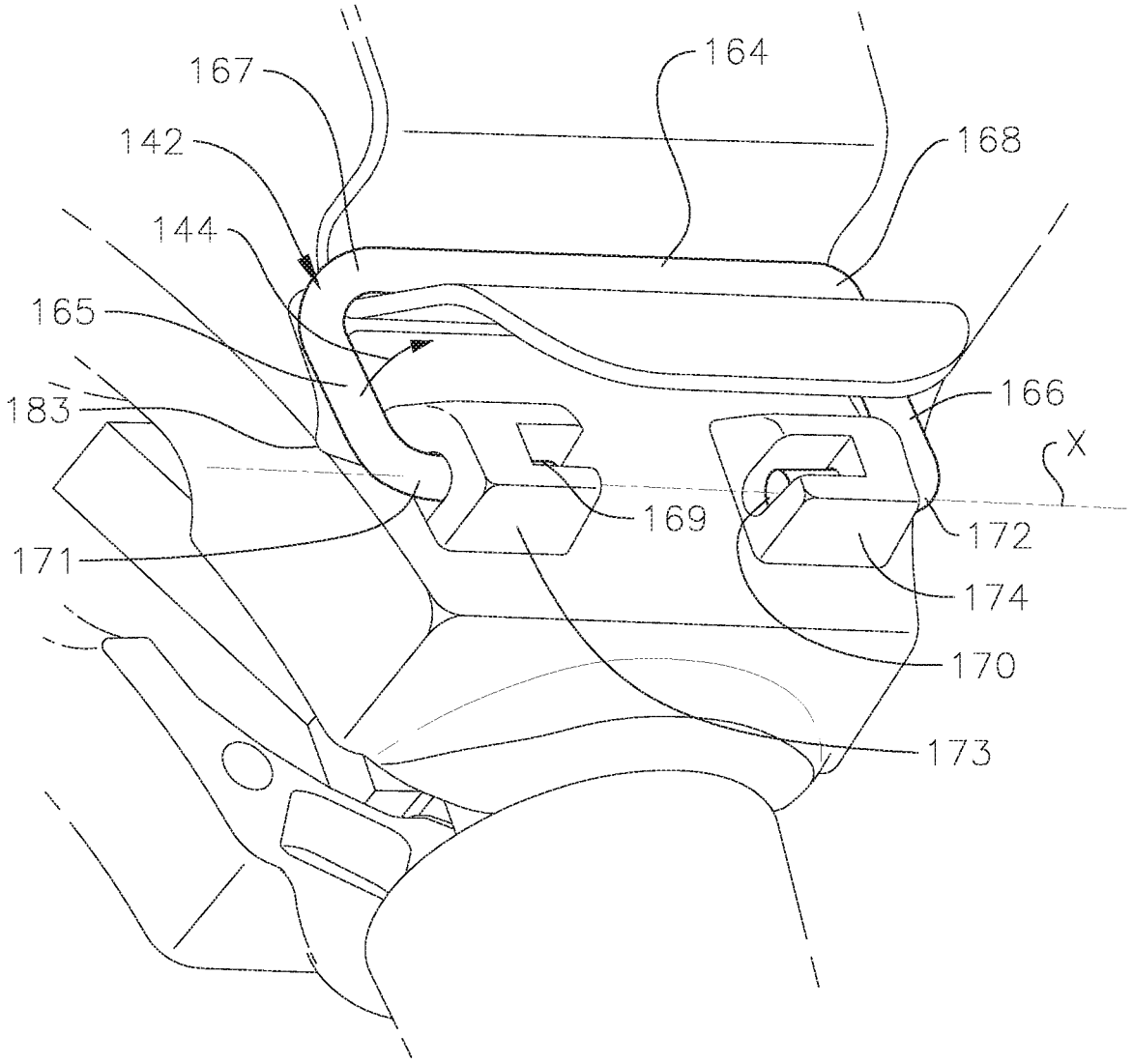
Figure 6C:
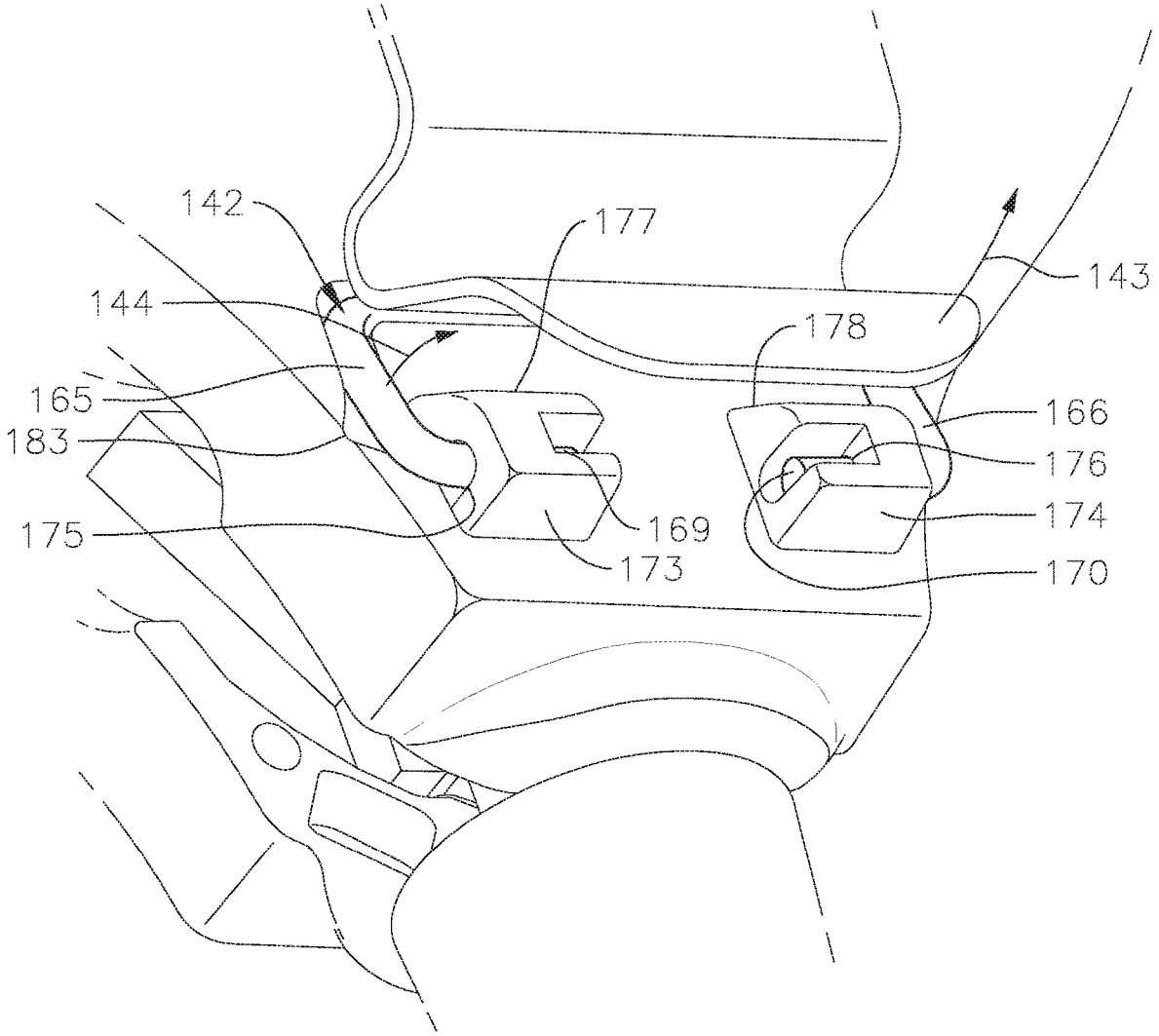

With reference now to the embodiment illustrated in FIGS. 4A-6C, the retractor device 100 also includes a device attachment assembly 140 coupled to the back plate 114 of the housing 101. The device attachment assembly 140 is configured to releasably secure the retractor device 100 to an article worn by a user (e.g., a belt, a strap, or a waistband). In the illustrated embodiment, the device attachment assembly 140 includes a belt clip 141 and a releasable locking member 142 configured to releasably secure (e.g., releasably lock) the belt clip 141 in a closed configuration. The locking member 142 is configured to move between a disengaged position (FIG. 6A), an engaged or locked position (FIGS. 4B and 6B), and a stowed position (FIGS. 4A and 6C). When the locking member 142 is in the disengaged position or the stowed position, the belt clip 141 is free to hinge (arrow 143) away from the back plate 141 into an open configuration in which the belt clip 141 may be slid onto the article worn by the user (e.g., belt, waistband, or strap). When the locking member 142 is in the locked position (FIGS. 4B and 6B), the locking member 142 is configured to prevent the belt clip 141 from hinging (arrow 143) into the open configuration (e.g., the locking member 142 is configured to releasably lock the belt clip 141 in the closed configuration). In one or more embodiments, the belt clip 141 may be slid onto the article (e.g., belt, waistband, or strap) and then the locking member 142 may be moved (arrow 144) into the locked position (e.g., from the stowed or disengaged position) to prevent the belt clip 141 from inadvertently disengaging the user's article. The locking member 142 may be rotated (arrow 144) into either the disengaged position or the stowed position to disengage the belt clip 141 from the user's article.

In the embodiment illustrated in FIGS. 4A and 5, the belt clip 141 is a generally U-shaped member including an inner leg 145 coupled to an exterior surface 146 of the back plate 114 of the first housing member 117, an outer leg 147 spaced apart from the inner leg 145, and a connection portion 148 (e.g., a U-shaped bend) connecting ends 149, 150 of the inner and outer legs 145, 147, respectively, together. An attachment opening 151 (see FIGS. 3A-3B) defined between the inner and outer legs 145, 147, the exterior surface 146 of the back plate 114, and the connection portion 148 is configured to accommodate a portion of the article (e.g., a user's belt, strap, or waistband) to which the device attachment assembly 140 is intended to be attached. Although in the illustrated embodiment the outer leg 147 is longer than the inner leg 145, in one or more embodiments, the inner and outer legs 145, 147 may have any other suitable relative lengths (e.g., the inner and outer legs 145, 147 may be the same or substantially the same length or the inner leg 145 may be longer than the outer leg 147). The outer leg 147 is configured to rotate (arrow 143) away from the exterior surface 146 of the first housing member 117 and the inner leg 145 into the open position. In one or more embodiments, the outer leg 147 is configured to hinge (arrow 143) into the open position about the first end 150 of the outer leg 147 proximate to connection portion 148. In one or more embodiments, the belt clip 141 is formed of a resilient and flexible material, such as, for instance, metal (e.g., die cut sheet metal) or plastic.

In the embodiment illustrated in FIGS. 3A, 3B, and 4A, the outer leg 147 includes a second end portion 152 opposite the first end 150 proximate to the connection portion 148 (e.g., a second end portion 152 distal to the connection portion 148). In the illustrated embodiment, the second end portion 152 of the belt clip 141 is a free or cantilevered end (e.g., an unsupported end of the belt clip 141). In the illustrated embodiment, the second end portion 152 of the outer leg 147 includes an inwardly-turned segment 153 extending inward from a generally flat intermediate segment 154 of the outer leg 147 toward the exterior surface 146 of the back plate 114 and an outwardly-turned segment 155 extending outward from the inwardly-turned segment 153 away from the exterior surface 146 of the back plate 114. Together, the inwardly-turned segment 153 and the outwardly-turned segment 155 of the outer leg 147 define a catch 156 (e.g., a U-shaped trough) at the free end portion 152 of the outer leg 147 configured to receive a portion of the locking member 142.

Additionally, in the illustrated embodiment, the free end portion 152 of the outer leg 147 also includes a lip 157. In the illustrated embodiment, the lip 157 is connected to an outer end 158 of the outwardly-turned segment 155. The lip 157 extends outwardly and away from the catch 156 of the belt clip 141. Additionally, in the illustrated embodiment, the lip 157 is angled relative to the outwardly-turned segment 155 of the outer leg 147 and forms an angle $\alpha$ (FIG. 3A) relative to the outwardly-turned segment 155 of the outer leg 147 ranging, for instance, from approximately 10 degrees to approximately 90 degrees (e.g., approximately 30 degrees). Additionally, in the illustrated embodiment, the outer leg 147 of the belt clip 141 includes a curved (e.g., rounded) portion 159 (FIG. 3A) connecting the outwardly-turned segment 155 to the lip 157.

In the illustrated embodiment, the inwardly-turned segment 153 and the outwardly-turned segment 155 of the outer leg 147 together define a retention portion 160 (FIG. 3A) extending inward toward the exterior surface 146 of the back plate 114 of the housing 101 relative to the generally flat intermediate segment 154 of the outer leg 147. In one or more embodiments, the retention portion 160 of the belt clip 141 contacts the exterior surface 146 of the back plate 114 of the housing 101 when the belt clip 141 is in a neutral state.

When the locking member 142 is in the stowed position or the disengaged position, the outer leg 147 of the belt clip 141 is free to rotate (arrow 143) outward away from the exterior surface 146 of the back plate 114 such that the belt clip 141 may be slid onto a user's article. For instance, when the locking member 142 is in the stowed position or the disengaged position, the user may grasp a portion of the outer leg 147 of the belt clip 141 and pull on the outer leg 147 to rotate (arrow 143) the outer leg 147 outward away from the exterior surface 146 of the back plate 114. Additionally, when the locking member 142 is in the stowed position or the disengaged position, the user may slide the user's article between the exterior surface 146 of the back plate 114 and the outer leg 147 of the belt clip 141 such that the user's article engages (e.g., contacts) the retention portion 160 of the belt clip 141, and the engagement between the retention portion 160 of the belt clip 141 and the user's article forces the outer leg 147 of the belt clip 141 to rotate (arrow 143) outward away from the back plate 114. In either case, the rotation (arrow 143) of the belt clip 141 outward away from the exterior surface 146 of the back plate 114 permits the user's article (e.g., belt, waistband, or strap) to pass into the attachment opening 151. Once the user's article has passed into the attachment opening 151, the outer leg 147 of the belt clip 141 may be returned to the neutral position by rotating the outer leg 147 toward the exterior surface 146 of the back plate 114. When the belt clip 141 is attached to the article (e.g., the belt, strap, waistband), the article is retained in the attachment opening 151 of the belt clip 141 by the connection portion 148, the retention portion 160, the outer leg 147, and the exterior surface 146 of the back plate 114 of the housing 101.

In the illustrated embodiment, an outer surface 161 of the outwardly-turned segment 155 facing the catch 156 includes an engagement member 162 extending into the catch 156. The engagement member 162 is configured to releasably retain the locking member 142 in the closed or locked position, as illustrated in FIGS. 4B and 6B. The engagement between the locking member 142 and the engagement member 162 when the locking member 142 is in the closed or locked position is configured to prevent the locking member 142 from inadvertently disengaging the outer leg 147 of the belt clip 141, which might otherwise permit the outer leg 147 to rotate (arrow 143) away from the back plate 114 of the housing 101 and thereby permit the user's article to slide out of the attachment opening 151 of the belt clip 141. The engagement member 162 may have any suitable configuration for engaging the locking member 142, such as, for instance, one or more projections, ridges, tabs, or flanges. In the illustrated embodiment, the engagement member 162 is an elongated ridge extending transversely across the outwardly-turned segment 155 of the outer leg 147. Additionally, in the illustrated embodiment, the engagement member 162 is located at an intermediate portion of the outwardly-turned segment 155 (e.g., an intermediate portion between an inner end 163 of the outwardly-turned segment 155 proximate to an innermost end of the catch 156 and the outer end 158 of the outwardly-turned segment 155 proximate to the lip 157). In one or more embodiments, the belt clip 141 may be provided without the engagement member 162.

With reference again now to the embodiment illustrated in FIGS. 6A-6C, the locking member 142 is a square-shaped ring including a cross-member 164 extending transversely, a pair of support arms 165, 166 extending longitudinally from opposite ends 167, 168, respectively, of the cross-member 164, and a pair of prongs 169, 170 extending transversely from ends 171, 172, respectively, of the support arms 165, 166 opposite the cross-member 164. In the illustrated embodiment, the prongs 169, 170 extend toward each other, although in one or more embodiments the prongs 169, 170 may extend away from each other. As described in more detail below, the cross-member 164 is configured to engage the belt clip 141 to releasably lock the belt clip 141 in the closed position, and the support arms 165, 166 and the prongs 169, 170 rotatably couple the locking member 142 to the housing 101. In one or more embodiments, the locking member 142 may have any other shape suitable for releasably locking the belt clip 141 in the closed configuration. For example, in one or more embodiments, the locking member 142 may be an annular ring or an annular ring with a flat or straight segment for engaging the belt clip 141 (e.g., a D-ring).

The locking member 142 is hingedly coupled to the back plate 114 proximate to the free end portion 152 of the outer leg 147 of the belt clip 141. In the illustrated embodiment, the locking member 142 is hingedly coupled to the back plate 114 of the housing 101 by a pair of hinge knuckles 173, 174 proximate to the free end portion 152 of the outer leg 147 of the belt clip 141. The hinge knuckles 173, 174 define a pair of coaxial openings 175, 176, respectively. The openings 175, 176 in the hinge knuckles 173, 174 define an axis X about which the locking member 142 is configured to rotate (arrow 144) between the stowed, disengaged, and locked positions. In the illustrated embodiment, the support arms 165, 166 of the locking member 142 straddle the hinge knuckles 173, 174, and the prongs 169, 170 of the locking member 142 extend into the openings 175, 176, respectively, in the hinge knuckles 173, 174. The prongs 169, 170 of the locking member 142 define an axle about which the locking member 142 is configured to rotate (arrow 144). In one or more embodiments, the locking member 142 may be hingedly coupled to the housing 101 in any other suitable manner. For instance, in one or more embodiments, the support arms 165, 166 of the locking member 142 may extend between the hinge knuckles 173, 174 and the prongs 169, 170 may extend away from each other and into the openings 175, 176 in the hinge knuckles 173, 174.

Additionally, in the illustrated embodiment, the hinge knuckles 173, 174 include sloped surfaces 177, 178 facing the attachment opening 151 of the belt clip 141. The hinge knuckles 173, 174 taper from a wider inner end at the exterior surface 146 of the back plate 114 to a narrower outer end distal to the exterior surface 146 of the back plate 114. The sloped surfaces 177, 178 of the hinge knuckles 173, 174 are configured to aid in detaching the retractor device 100 from the user's article (e.g., belt, strap, or waistband). For instance, the locking member 142 may be moved (arrow 144) into the stowed position and then the article may be slid out of the attachment opening 151 by sliding the article between the retention portion 160 of the belt clip 141 and the exterior surface 146 of the back plate 114 of the housing 101. The article may then be slid along the sloped surfaces 177, 178 of the hinge knuckles 173, 174 to separate the retractor device 100 from the article (e.g., the user's belt, strap, or waistband). Otherwise, sharply angled surfaces of the hinge knuckles 173, 174 (e.g., surfaces angled perpendicular to the exterior surface 146 of the back plate 114) could hinder removal of the article from the attachment opening 151 of the belt clip 141 and detachment of the retractor device 100 from the user's person.

With continued reference to the embodiment illustrated in FIGS. 6A-6C, the back plate 114 of the housing 101 defines a recess 179 configured to accommodate at least a portion of the locking member 142 when in a stowed position. In the illustrated embodiment, the recess 179 is U-shaped and includes a transverse segment 180 and a pair of longitudinal segments 181, 182 extending from opposite ends of the transverse segment 181. In one or more embodiments, the recess 179 may have any other suitable shape depending, for instance, on the configuration of the locking member 142. In one or more embodiments, the shape of the recess 179 may correspond or substantially correspond to the shape of the locking member 142 (e.g., the shape of the recess 179 may conform or substantially conform to the shape of the locking member 142). The locking member 142 is configured to be received in the recess 179 when the locking member 142 is in the stowed configuration, as illustrated in FIG. 6C. In one or more embodiments, the recess 179 is configured (e.g., sized) such that when the locking member 142 is in the stowed configuration and received in the recess 179, at least a portion of the locking member 142 is flush or substantially flush (e.g., co-planar) with the exterior surface 146 of the back plate 114. In one or more embodiments, the recess 179 is configured (e.g., sized) such that when the locking member 142 is in the stowed configuration and received in the recess 179, the locking member 142, or at least a portion thereof, is recessed below the exterior surface 146 of the back plate 114. Storing the locking member 142 in the recess 179 (i.e., the stowed position of the locking member 142) is configured to allow a user's article (e.g., belt, strap, or waistband) to pass between the retention portion 160 and the exterior surface 146 of housing 101 and into the attachment opening 151. Otherwise, the locking member 142 may engage (e.g., snag) the article or otherwise obstruct or hinder insertion of the article into the attachment opening 151.

Additionally, in the illustrated embodiment, the sidewall 116 of the housing 101 defines a pair of opposing notches 183, 184 (only one notch 183 visible in FIGS. 6A-6C; notch 184 visible in FIG. 3A) that open up into the recess 179 in the back plate 114 of the housing 101. In the illustrated embodiment, the notches 183 are arcuate shaped, although in one or more embodiments the notches 183 may have any other suitable shape (e.g., polygonal shaped). When the locking member 142 is in the stowed configuration and received in the recess 179 in the back plate 114, the opposing pair of notches 183 exposes opposing portions of the locking member 142 (e.g., portions of the support arms 165, 166) along the sidewall 116 of the housing 101. The notches 183 are configured to facilitate or aid removal of the locking member 142 from the recess 179. For example, a user may insert his finger or fingernail into one of the notches 183 and under a portion of the locking member 142 to pry the locking member 142 from the recess 179. In one or more embodiments, the housing 101 may include only a single notch 183. Additionally, in the illustrated embodiment, the notches 183 are positioned along ends of the longitudinal segments 181, 182 of the recess 179 proximate to the hinge knuckles 173, 174, although in one or more embodiments the recesses 183 may be located in any other suitable position (e.g., positioned along ends of the longitudinal segments 181, 182 of the recess 179 proximate to the transverse segment 180).

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is referred to as being "coupled" to another component, it can be directly attached to the other component or intervening components may be present therebetween.

What is claimed is:

1. A retractor device, comprising:

a housing comprising a back wall, a front wall spaced apart from the back wall, and at least one sidewall extending between the back wall and the front wall;

a rotatable reel inside the housing;

a spring biasing rotation of the rotatable reel in one direction;

a tether at least partially wound around the rotatable reel, the tether comprising a first end coupled to the rotatable reel and a second end opposite the first end;

an end fitting coupled to the second end of the tether, the end fitting comprising an enlarged inner end having a width, wherein the end fitting and the tether are configured to move between a retracted position and an extended position;

a retainer of the housing in contact with the end fitting when the end fitting is in the retracted position;

at least one bearing inside the housing proximate to the retainer;

first and second extension openings defined in the sidewall of the housing on opposite sides of the retainer;

a belt clip coupled to an exterior surface of the back wall of the housing, the belt clip comprising:

an inner leg on the exterior surface; and an outer leg connected to the inner leg, the outer leg comprising an inwardly-turned segment and an outwardly-turned segment connected to the inwardly-turned segment, the inwardly-turned segment and the outwardly-turned segment together defining a catch; and a locking member hingedly coupled to the exterior surface of the back wall of the housing, the locking member configured to rotate between a stowed position and a locked position engaging the belt clip.

2. The retractor device of claim 1, wherein:

the retainer comprises a slot in the at least one sidewall of the housing, and a stem of the end fitting is received in the slot when the end fitting is in the retracted position.

3. The retractor device of claim 2, further comprising:

a first pair of stops extending into the slot; and a second pair of stops extending into the slot, wherein the first and second pairs of stops are on opposite sides of the stem when the end fitting is in the retracted position, and wherein a distance between the stops of each of the first and second pairs of stops is less than a width of the stem.

4. The retractor device of claim 1, further comprising a recess defined in the exterior surface of the housing, the recess configured to accommodate at least a portion of the locking member in the stowed position.

5. The retractor device of claim 4, further comprising at least one notch defined in the at least one sidewall of the housing, the at least one notch opening up into the recess.

6. The retractor device of claim 1, wherein the belt clip further comprises an engagement member on the outwardly-turned segment extending into the catch, wherein engagement between the portion of the locking member and the engagement member is configured to retain the locking member in the locked position.

7. The retractor device of claim 6, wherein the engagement member is a ridge extending transversely across the belt clip.

8. The retractor device of claim 1, wherein the locking member is a square-shaped ring.

9. The retractor device of claim 1, wherein the belt clip further comprises a lip extending from an outer end of the outwardly-turned segment of the outer leg.

10. The retractor device of claim 9, wherein the lip is angled relative to the outwardly-turned segment away from the catch.

* * * * *